US010589408B2

(12) United States Patent
Carati

(10) Patent No.: US 10,589,408 B2
(45) Date of Patent: Mar. 17, 2020

(54) NAILER DEVICE FOR COLLATED NAILS

(71) Applicant: FASCO S.R.L., Granarolo dell'Emilia, Bologna (IT)

(72) Inventor: Andrea Carati, Bologna (IT)

(73) Assignee: FASCO S.R.L. (IT)

( * ) Notice: Subject to any disclaimer, the term of this patent is extended or adjusted under 35 U.S.C. 154(b) by 543 days.

(21) Appl. No.: 15/390,213

(22) Filed: Dec. 23, 2016

(65) Prior Publication Data

US 2017/0182644 A1 Jun. 29, 2017

(30) Foreign Application Priority Data

Dec. 24, 2015 (IT) ..... 102015000087792

(51) Int. Cl.
*B25C 1/00* (2006.01)
*B25C 1/18* (2006.01)

(52) U.S. Cl.
CPC ..... *B25C 1/005* (2013.01); *B25C 1/003* (2013.01); *B25C 1/184* (2013.01)

(58) Field of Classification Search
CPC ..... B25C 1/005; B25C 1/184; B25C 1/003
USPC ..... 227/136
See application file for complete search history.

(56) References Cited

U.S. PATENT DOCUMENTS 3,589,584 A 6/1971 Ohlsson
3,623,646 A 11/1971 Cast
4,072,261 A * 2/1978 Livio ..... B25C 1/04 227/130
5,452,796 A * 9/1995 Ohuchi ..... B21J 15/323 206/338
5,738,266 A * 4/1998 Ogawa ..... B25C 1/003 227/119
6,006,975 A * 12/1999 Ishizawa ..... B25C 1/047 227/119
6,308,880 B1 * 10/2001 Ronconi ..... B25C 1/003 227/119
2002/0113114 A1 * 8/2002 Hamano ..... B25C 1/003 227/156
2004/0035906 A1 * 2/2004 Tucker ..... B25B 23/045 227/142

(Continued)

OTHER PUBLICATIONS

Search Report and Written Opinion dated Sep. 8, 2016, application ITUB20159529, 7 pages.

*Primary Examiner* — Michelle Lopez
*Assistant Examiner* — Chinyere J Rushing-Tucker
(74) *Attorney, Agent, or Firm* — Ware, Fressola, Maguire & Barber LLP

(57) ABSTRACT

A nailer device for collated nails (S) can be loaded with an elongated strip (E) almost flat shaped and provided with at least a plurality of first connections (P) projecting therefrom and each provided with a fixing end (F) opposite to the elongated strip (E) and assigned to the removable fixing of a respective nail (N) of collated nails. The device (1) includes a sliding seat (9) aligned with a magazine (3) and in communication with a shot chamber (5) that receives the elongated strip (E). Thrusting means (13) is provided with a matching means (15) assigned to match with the fixing end (F) of the first connection (P) previously bearing a fired nail in a stroke of the thrusting means from an external extreme condition to an extreme internal condition to align the first connection (P) of such fixing end (F) to a portion of the sliding seat.

15 Claims, 12 Drawing Sheets

(56) References Cited

U.S. PATENT DOCUMENTS

2008/0179372 A1* 7/2008 Kurth ..... B25C 1/184
227/136

* cited by examiner

FIG.1
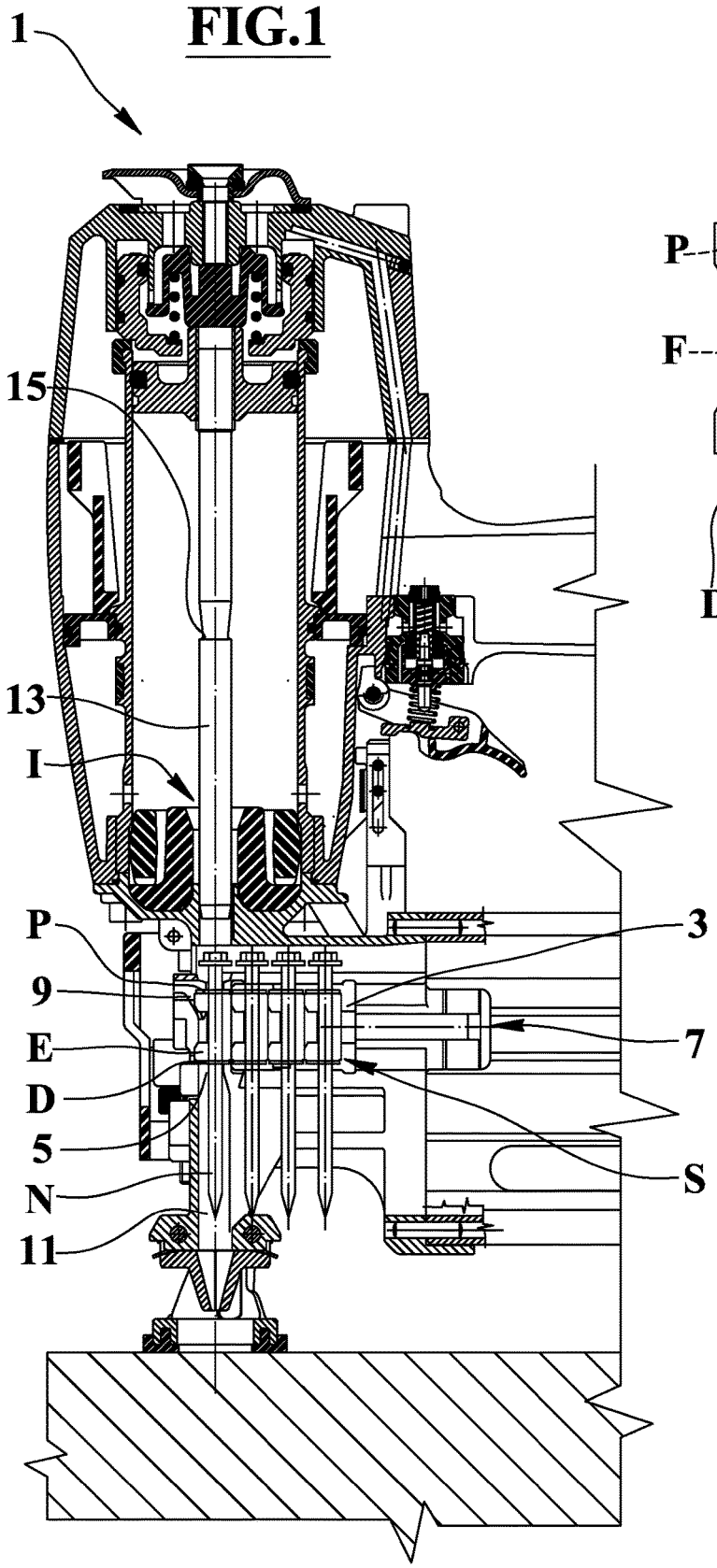
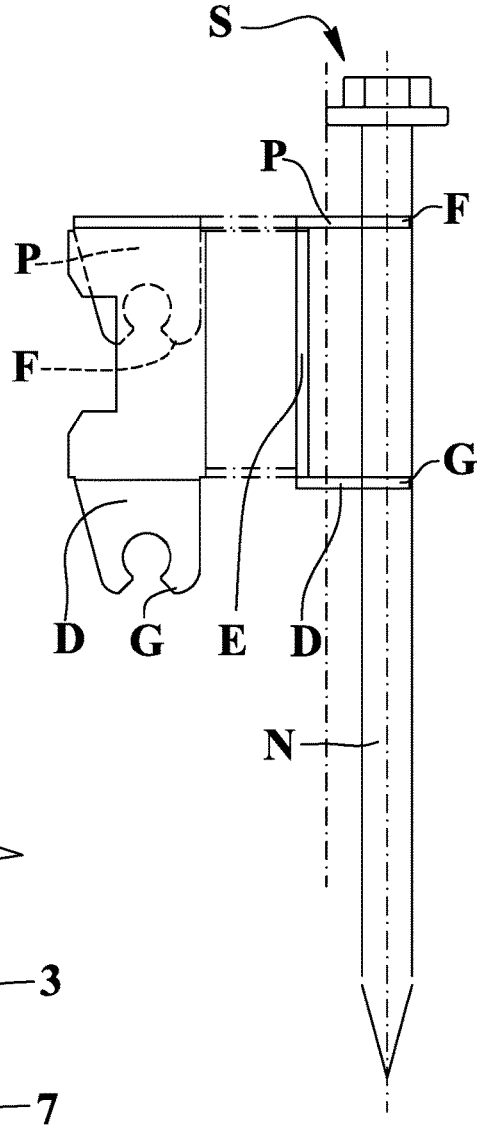
FIG.2

FIG.4
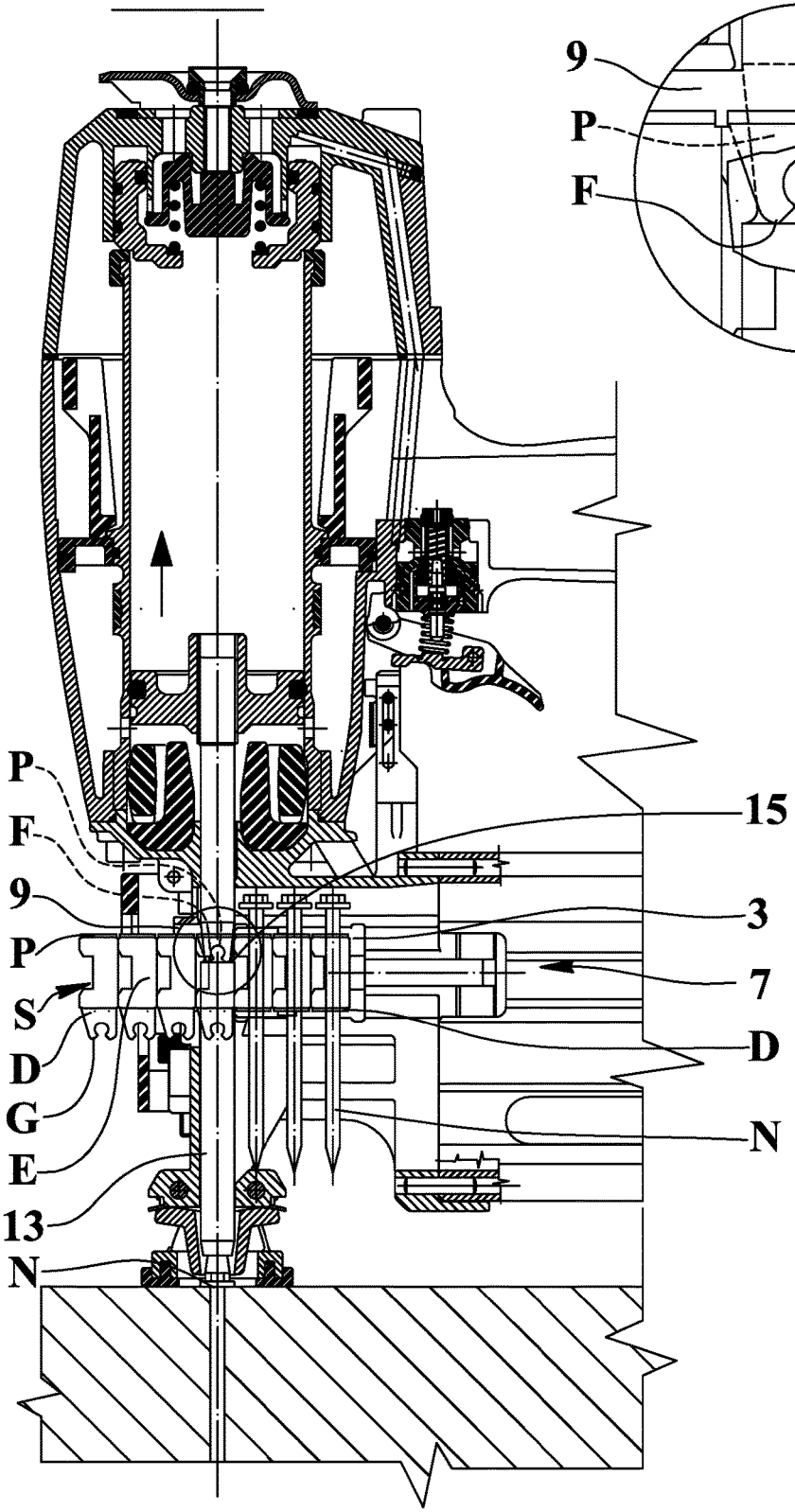
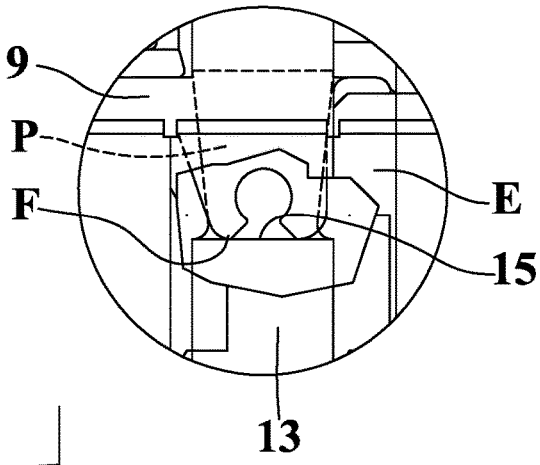
FIG.5

NAILER DEVICE FOR COLLATED NAILS

BACKGROUND

The present invention relates to the field concerning tools for application of nails or similar fixing and refers to a nailer device for fasteners collated on a long support strip or nails collated on an elongated support element, such as plastic, the nailer assigned to expel and to fix one nail at a time and to permit the discharge of said support strip of the nails little by little as the nails are fired one by one up to the last one.

Nailers, nail guns, or nails-shooting machines, are known, for example pneumatically operated or manually operated, equipped with a fixed magazine in which they can be loaded, through a little door generally placed on the side, to receive the strips or bands of nails or collated nails.

Such strips, sticks or bands of nails, indicated below with the term "collated nails", may include an elongated plastic strip with a nearly flat surface, equipped with couples of connections where each couple of connections is assigned to or for removable fixing of a respective nail. A first connection of each couple is connected to one of the longitudinal edges of the elongated strip and the other and second connection of the same couple is fixed to the other longitudinal edge of the elongated strip. Such connections first and second, when engaged by the stem of the nail, are mutually faced and they stick out perpendicularly from the plastic elongated strip with which they form a unique body.

The ends of the connections opposed to the elongated strip bring respective recesses shaped as a circumferential arc which subtends to an angle exceeding 180° and which has radius equal or slightly lower to the stem of the nail.

The elongated plastic strip, carrier, support, or element is shifted by a feeding mechanism along a respective sliding seat of the magazine towards an exit for the elongated strip itself, through a shot chamber of the nailer. After each shot, the feeding mechanism shifts the elongated strip towards its exit, arranging a new nail into the shot chamber while aligning it with a nail outlet duct.

At the time of the shot a thrusting means, also a driver, aligned to the nail outlet duct and translating through the shot chamber and along the nail outlet duct, matches with the head of the nail into the shot chamber and shoots the nail through the outlet duct. During such firing action, the head of the nail and/or the thrusting means bend the first and second connections of the nail during ejection arranging them parallely to the plane defined by the elongated strip.

A disadvantage of such known nailers consists in that, despite the presence of planes and chamfers for repositioning the first connection, or rather of the one opposite to the exit for the nail, in the original orientation which was perpendicular to the elongated strip and then to facilitate its sliding in the exit section of the respective sliding seat, such attempts nevertheless present lots of jams and blocks caused by dead stopping or unwanted arrest of the first connections opposite to the exit for the nail (or rather positioned near the piston which activates the pusher) of the elongated support element into the respective sliding seat.

A further disadvantage of said known nailers consists in that the respective feeding mechanism cannot execute the right positioning of the last nail of the stick or rather of the nail fixed to the last couple of connections of the elongated element.

BRIEF SUMMARY

An object of the present invention is to propose a nailer device for collated nails nearly free of jams or malfunctions caused by dead stopping or unwanted arrest of the connections for the nails of the elongated strip of the collated nails in the exit section of the respective sliding seat.

Another object is to propose a nailer device for collated nails which can also shoot without risk of jamming the last nail of the stick.

BRIEF DESCRIPTION OF THE SEVERAL VIEWS OF THE DRAWING

The characteristics of the invention are underlined below with particular reference to the enclosed drawings in which:

FIG. 1 illustrates a schematic partial view, longitudinally sectioned, of a nailer device for collated nails, according to the present invention, in armed condition in which the shot chamber houses a nail of the stick and in which a muzzle of the chamber is in contact with a piece to nail;

FIG. 2 illustrates a side and enlarged view of the collated nails of the FIG. 1 in which a segment of the elongated strip of such collated nails is also represented in a bended position, successive to the shot of the respective nail;

FIG. 4 illustrates the device of FIG. 1 in a condition in which the pusher is in its return stroke and matching means of the thrusting means matches with a free end of the first connection, opposite to the exit of the fired nail;

FIG. 5 illustrates an enlarged particular of FIG. 4 in which the match between the matching means of the thrusting means and the free end of the first connection is illustrated;

DETAILED DESCRIPTION

Figure 3:
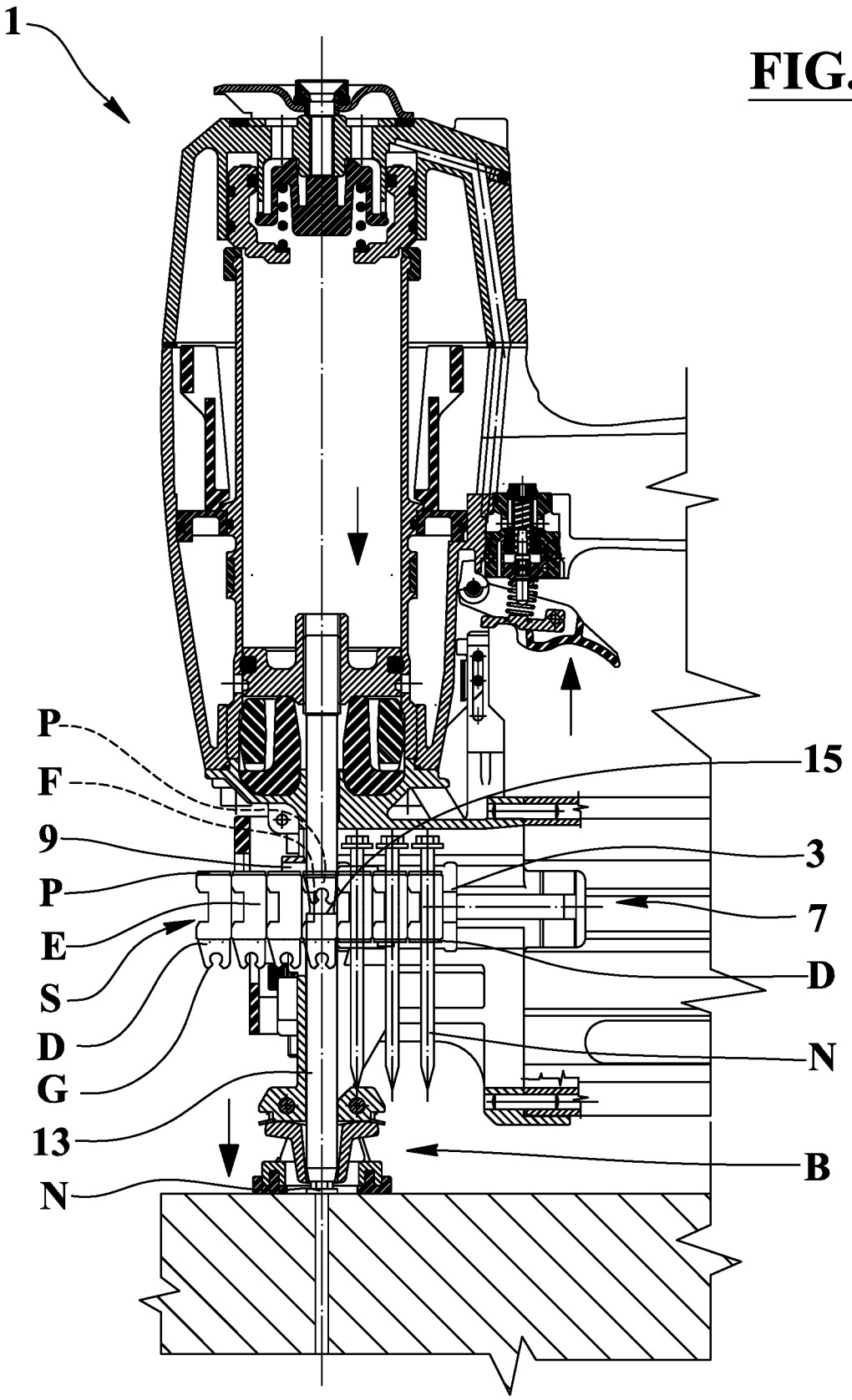
FIG. 3 illustrates the device of FIG. 1 in a nail firing condition with the pusher in its external extreme position.
Figure 6:
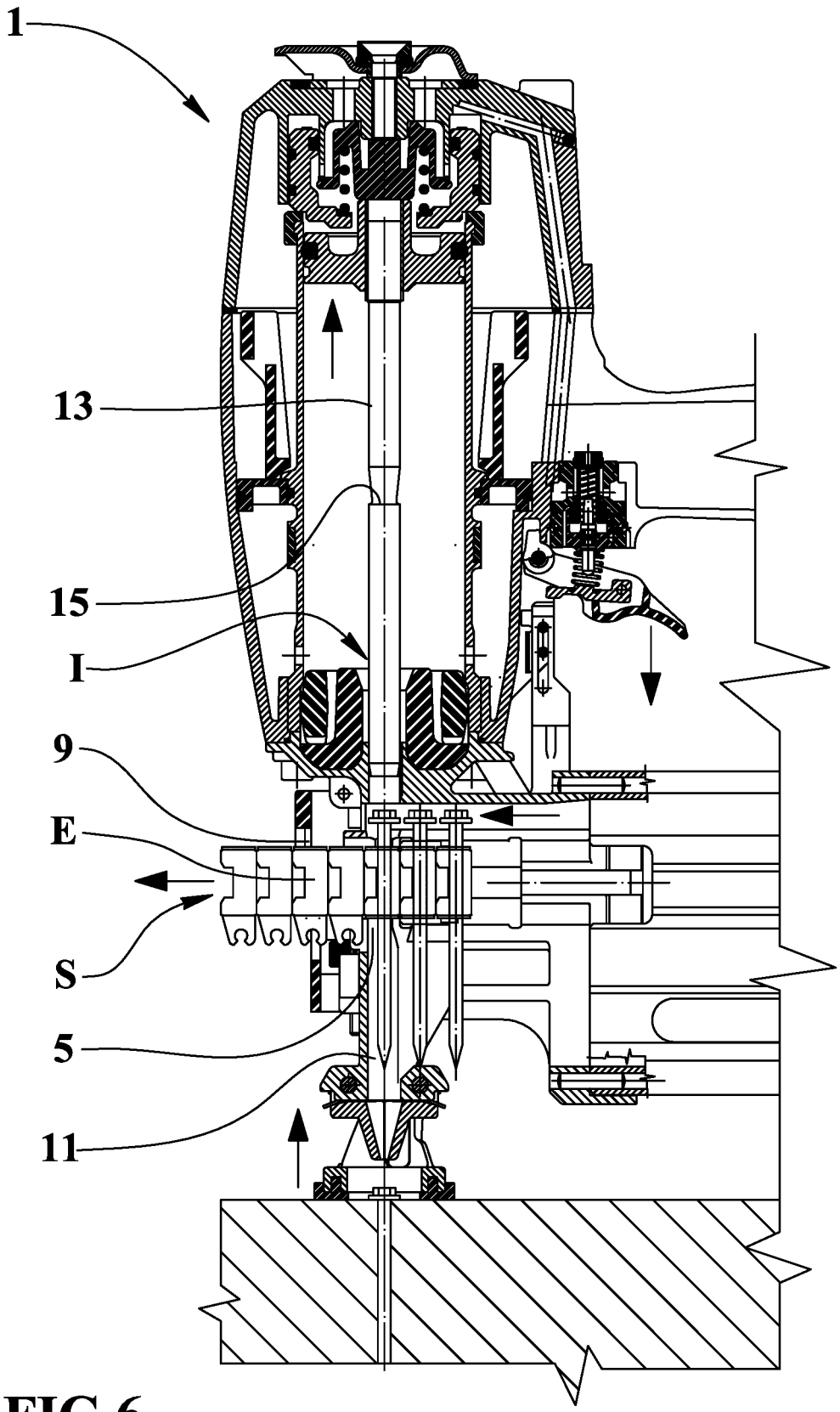
FIG. 6 illustrates the device in FIG. 1 in a condition in which the pusher completed his return stroke to the initial condition during which the matching means placed the first connection is in its original orientation, to permit the carrier sliding into the respective guide by means of the feeding mechanism which placed the next nail in the shot chamber.
Figure 8:
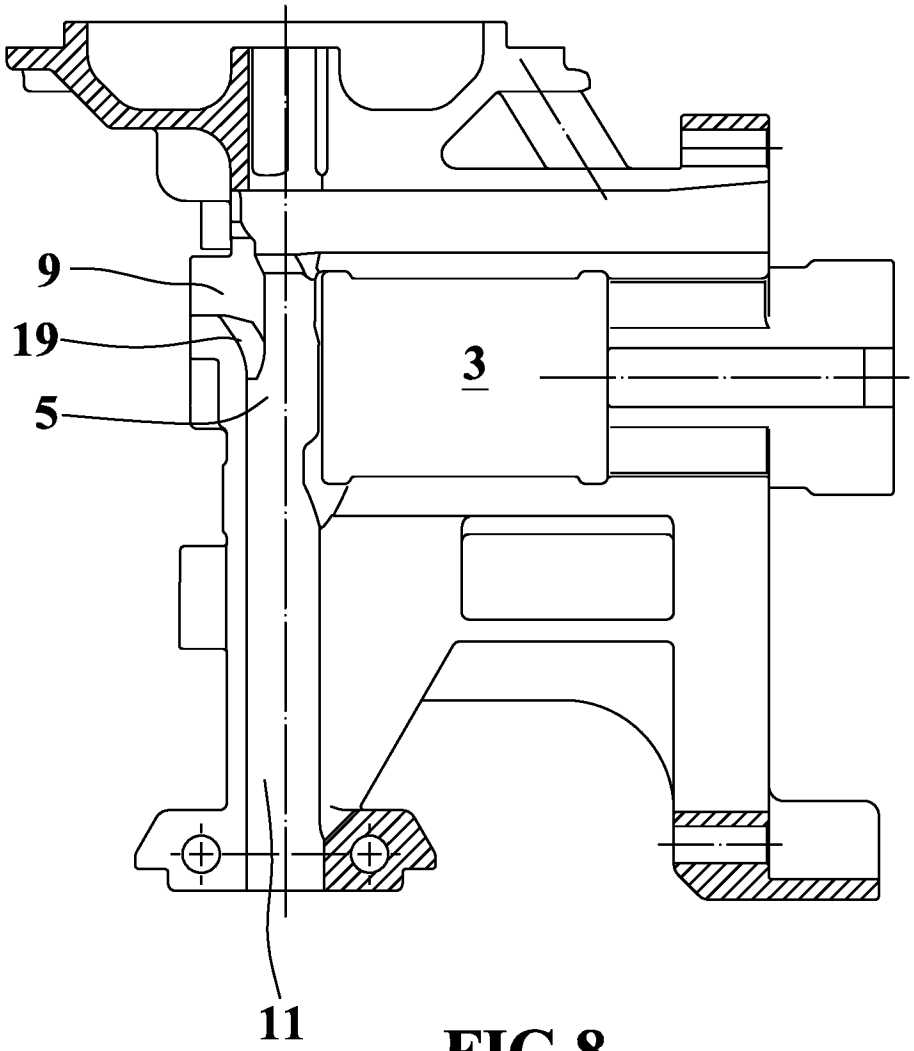
FIGS. 7 and 8 illustrate section views according to respective transversal plane and the same longitudinal plane of section in FIG. 1 of the portion of the device having the shot chamber, the nail outlet duct, the sliding seat and the magazine.
Figure 7:
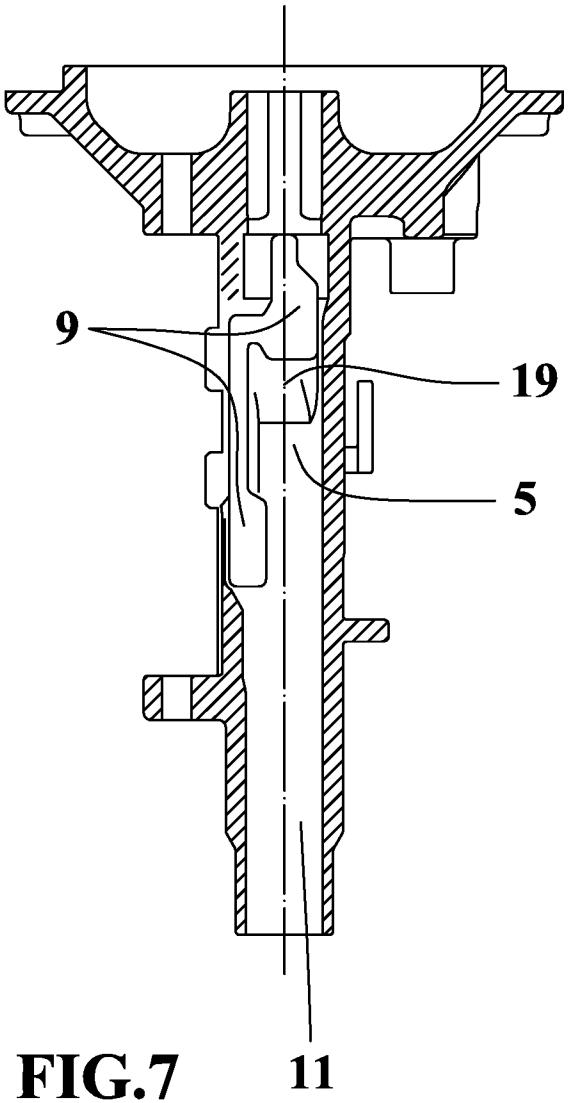
Figure 10:
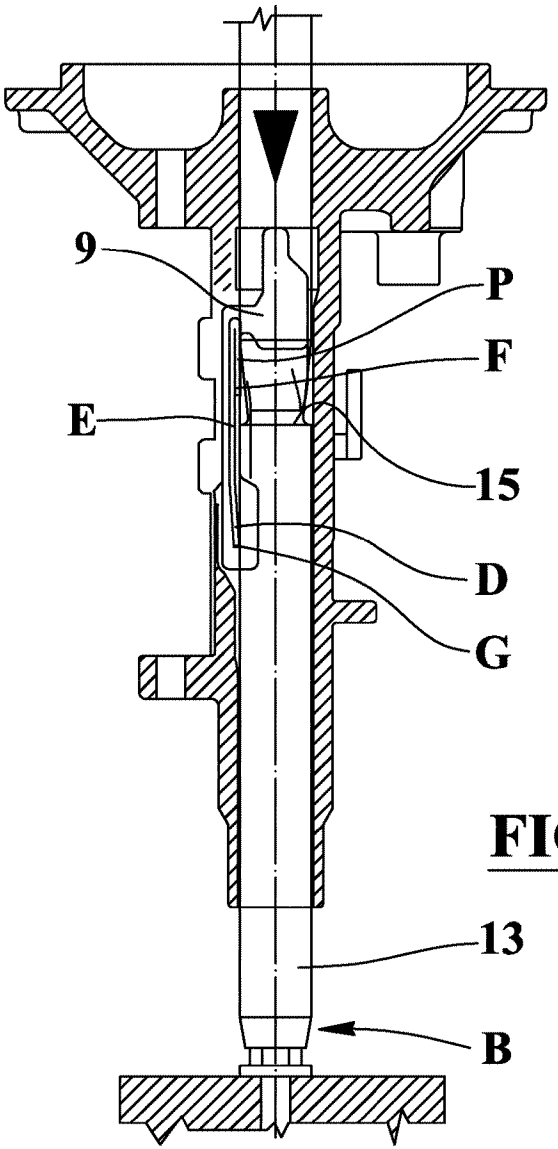
FIGS. 9-14 illustrate the portion of the device of FIG. 7 in respective and consecutive conditions of operation: armed, end of the shot, the match between the first connection and the matching means during the return stroke of the thrusting means, the approximate alignment of the first connection to the geometric plane of the elongated strip of the stick, the return of the first connection to the same orientation or to a similar one to the one of the beginning and the free sliding of the elongated strip into the respective sliding seat.
Figure 9:
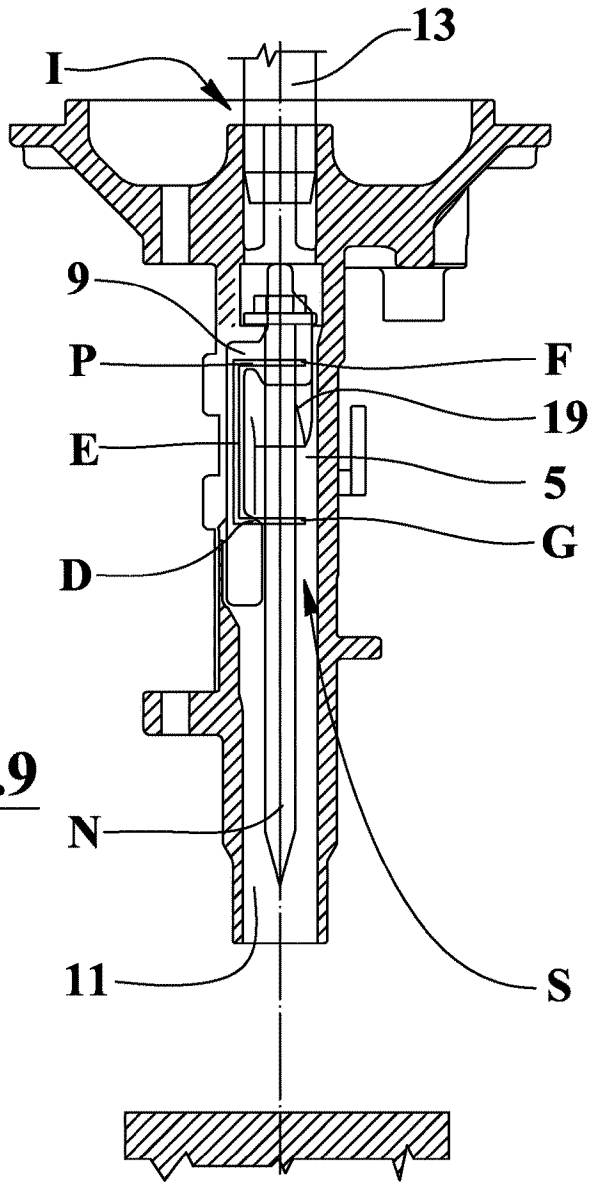
Figure 12:
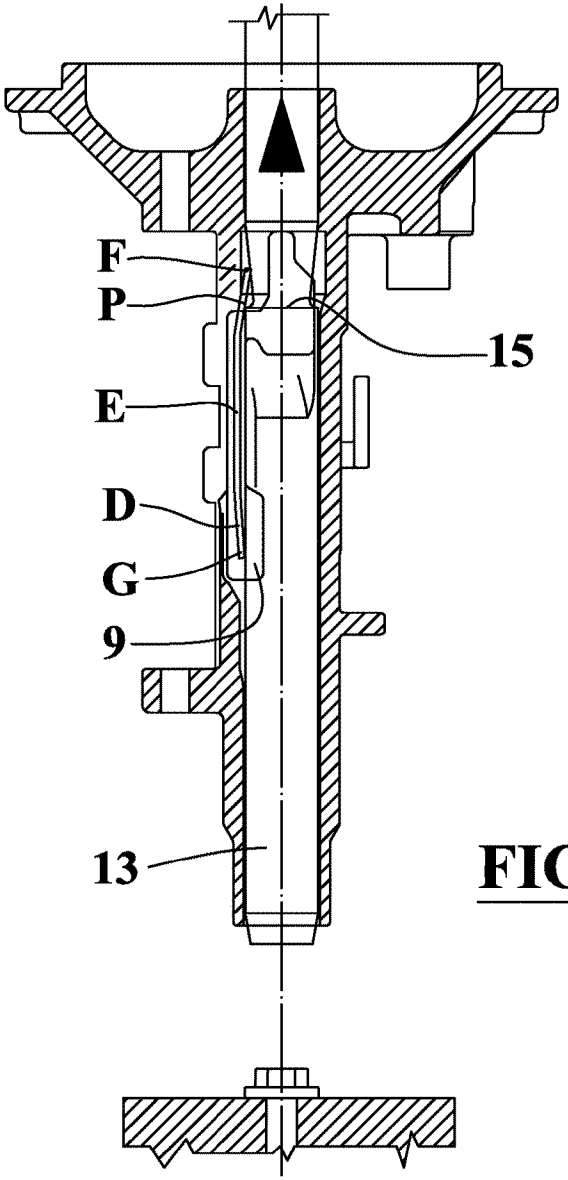
Figure 11:
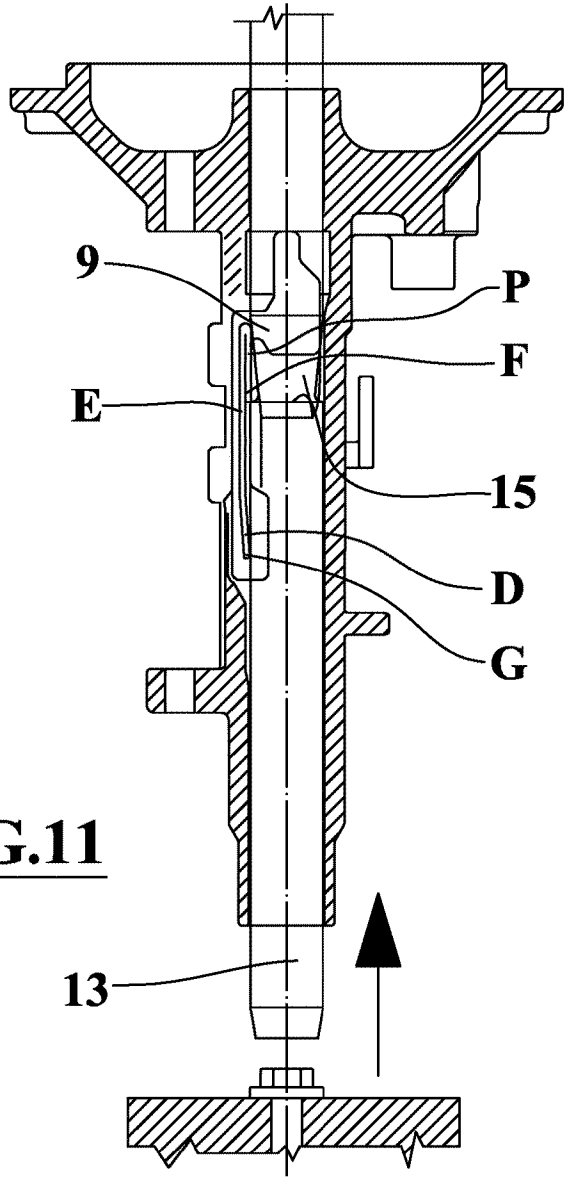
Figure 14:
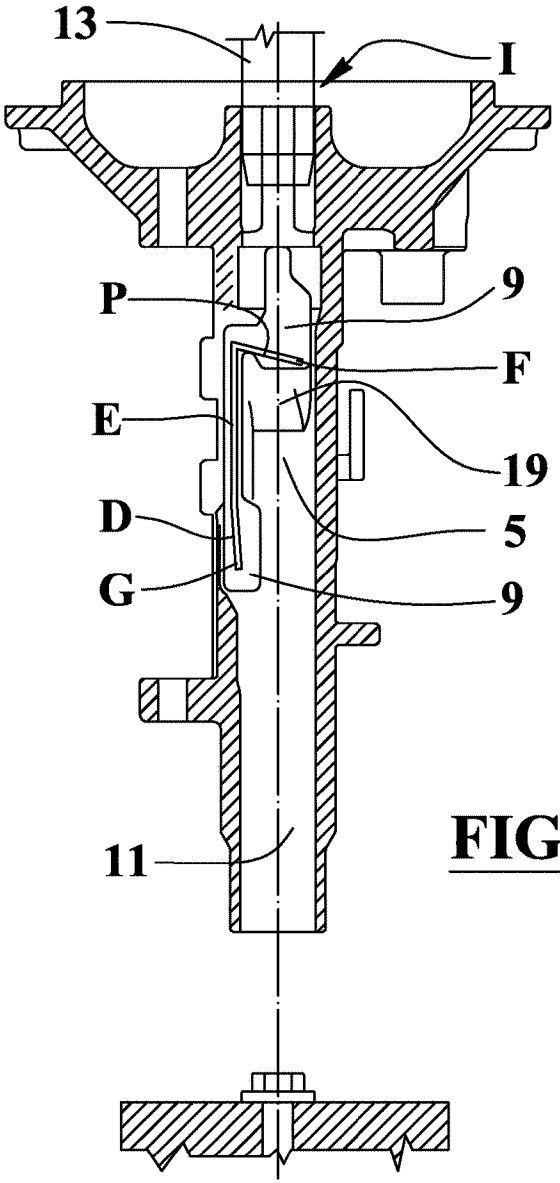
Figure 13:
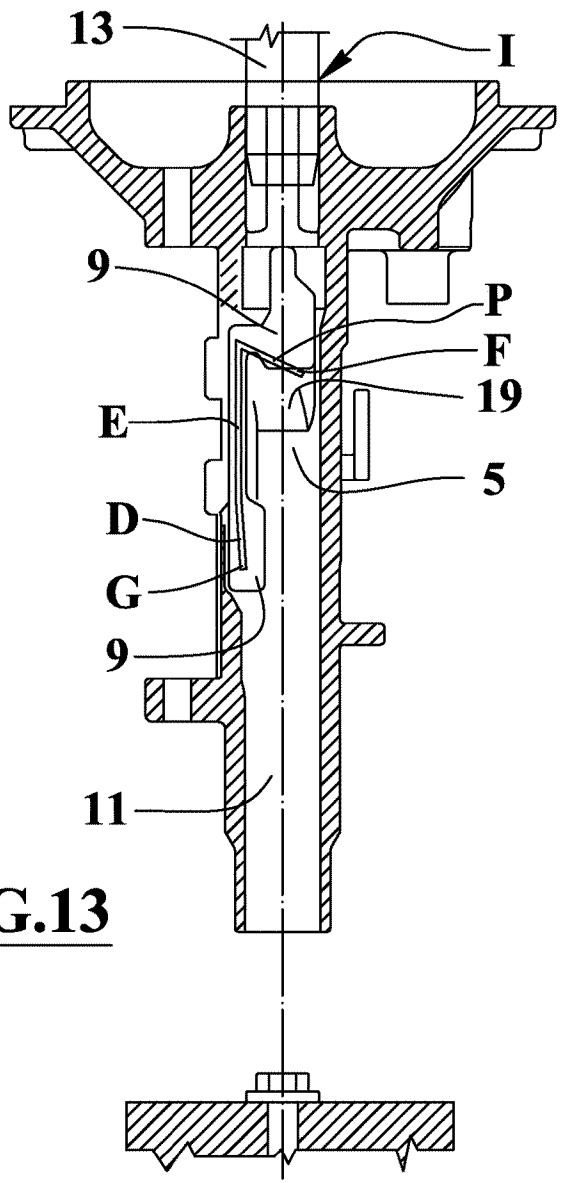
Figure 15:
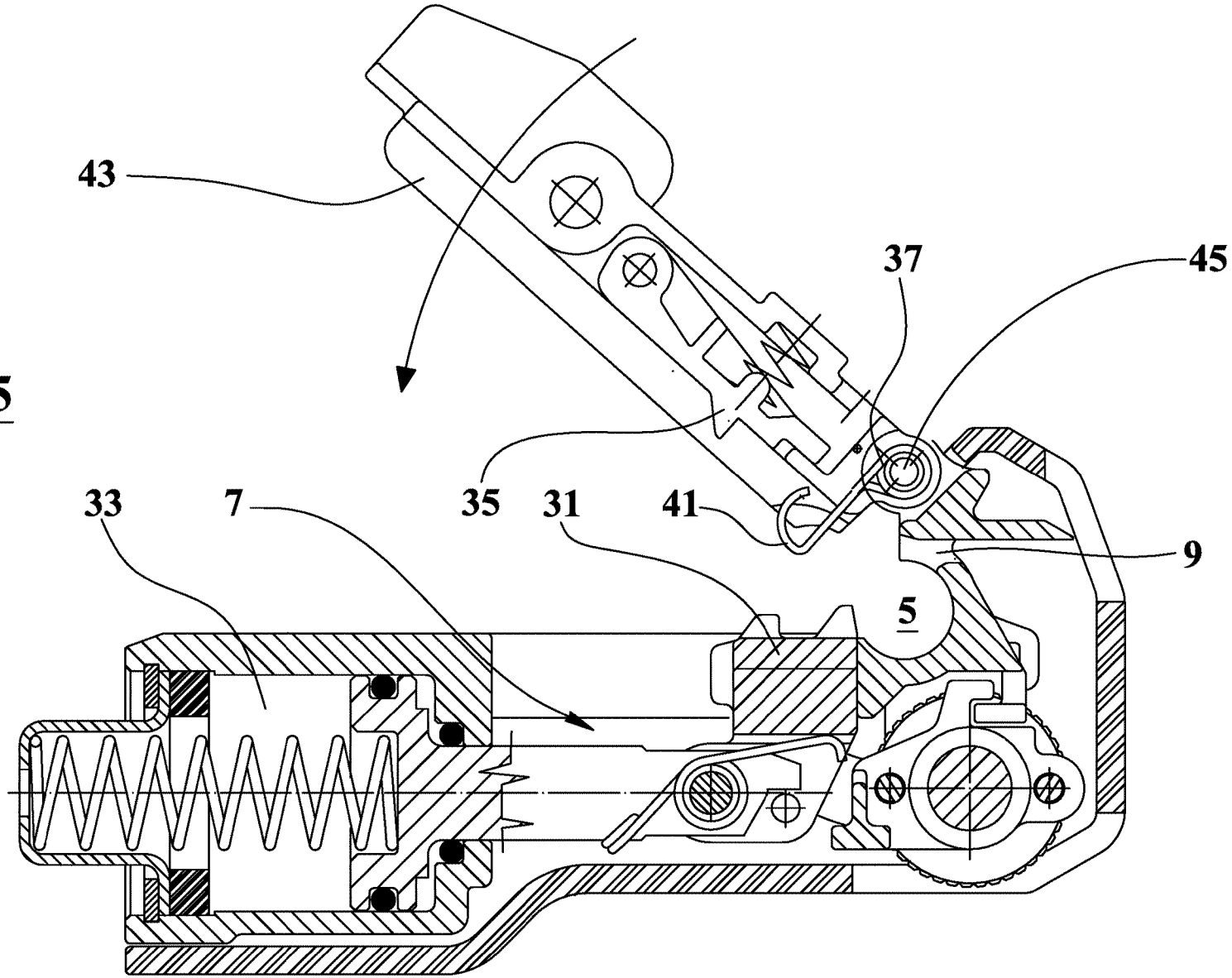
FIGS. 15-18 illustrate partial and sectioned views according to a longitudinal plane orthogonal compared to the one in the section of FIG. 1 in conditions of: opening of a door for introduction of collated nails in the magazine of the machine, end of the stroke backwards of a ratchet gear of the feeding mechanism of the stick the end of the ratchet gear feed stroke with positioning of a nail in the shot chamber and the positioning of the last nail in the shot chamber from a feed elastic means and check.
Figure 16:
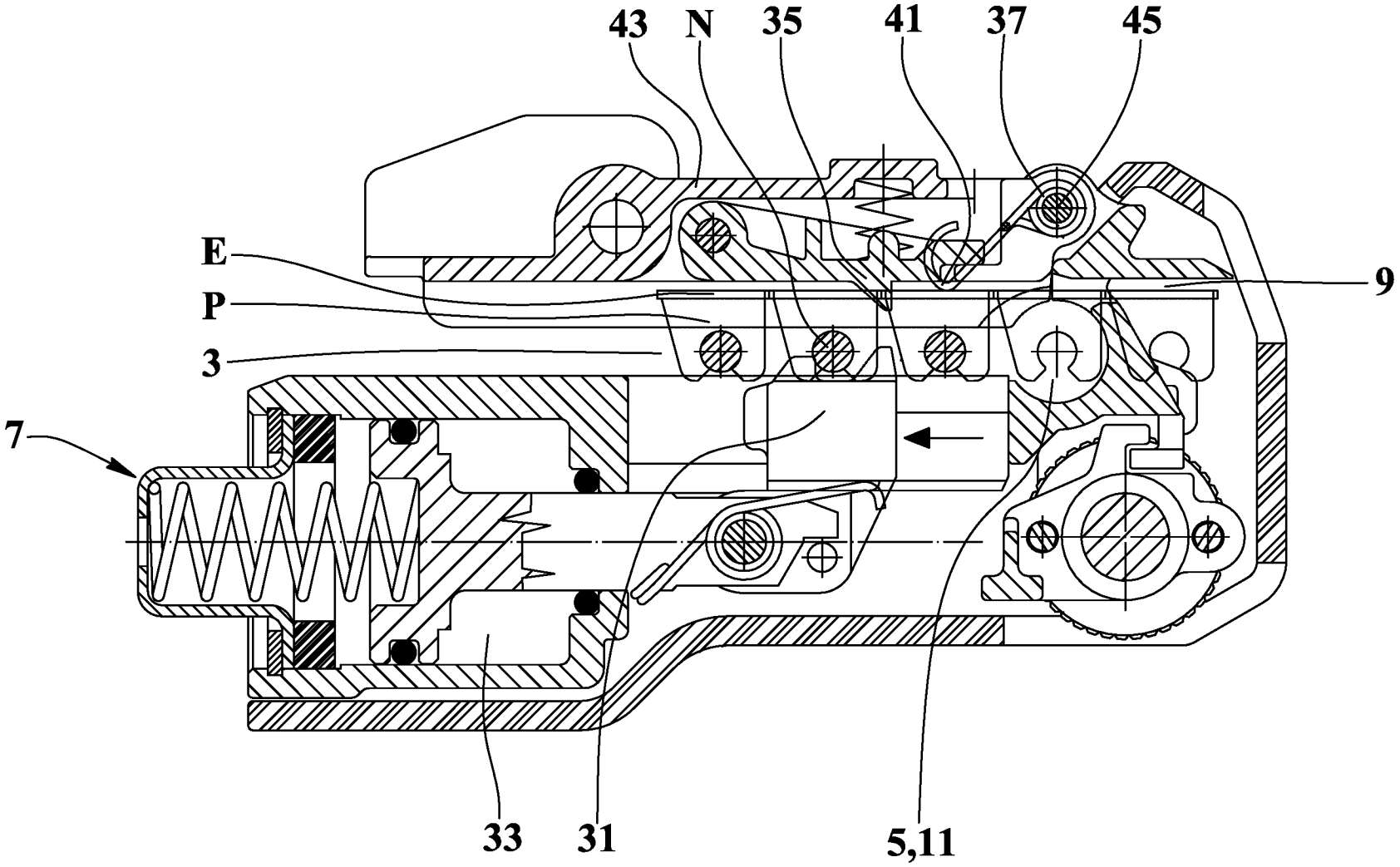
Figure 17:
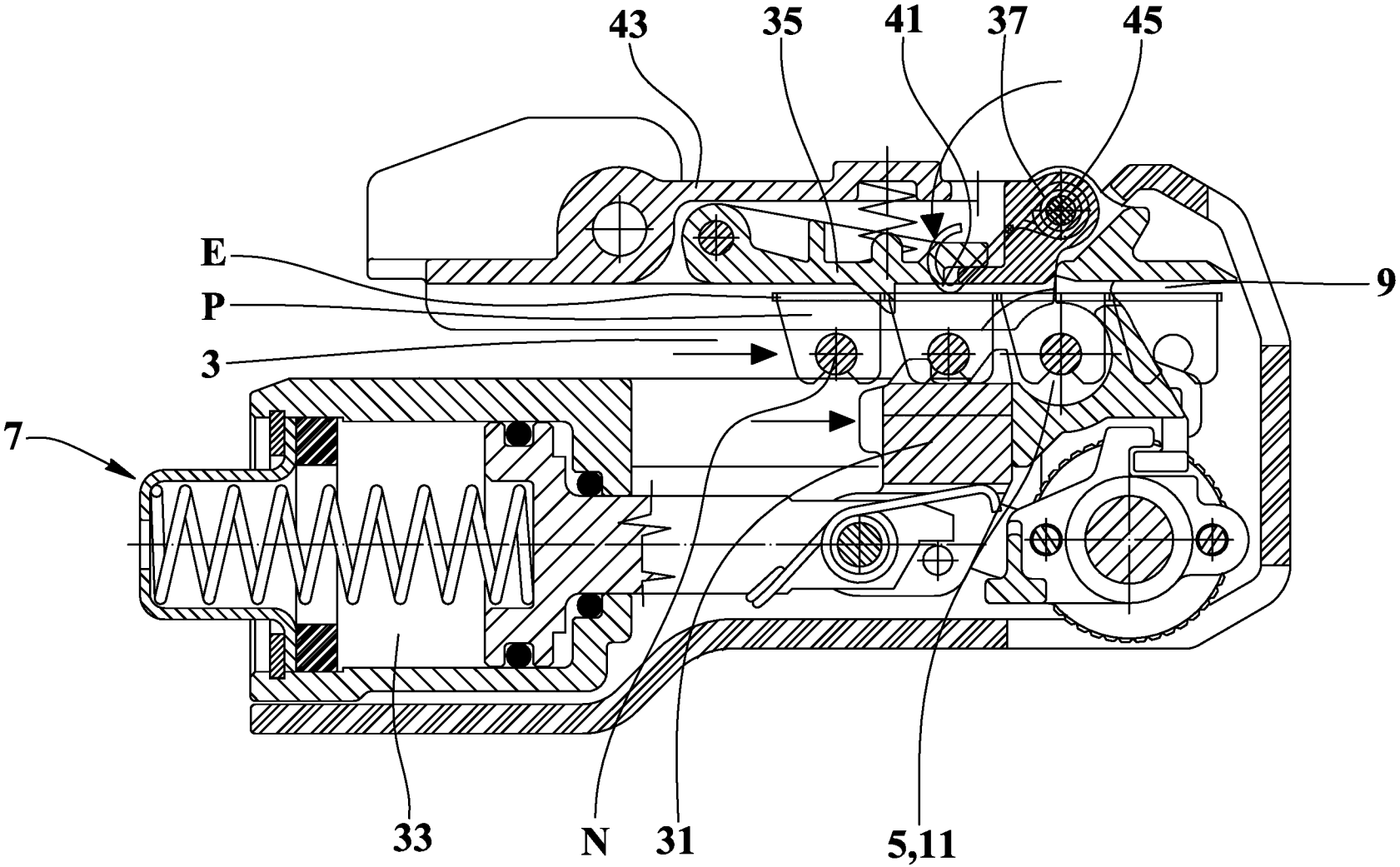
Figure 18:
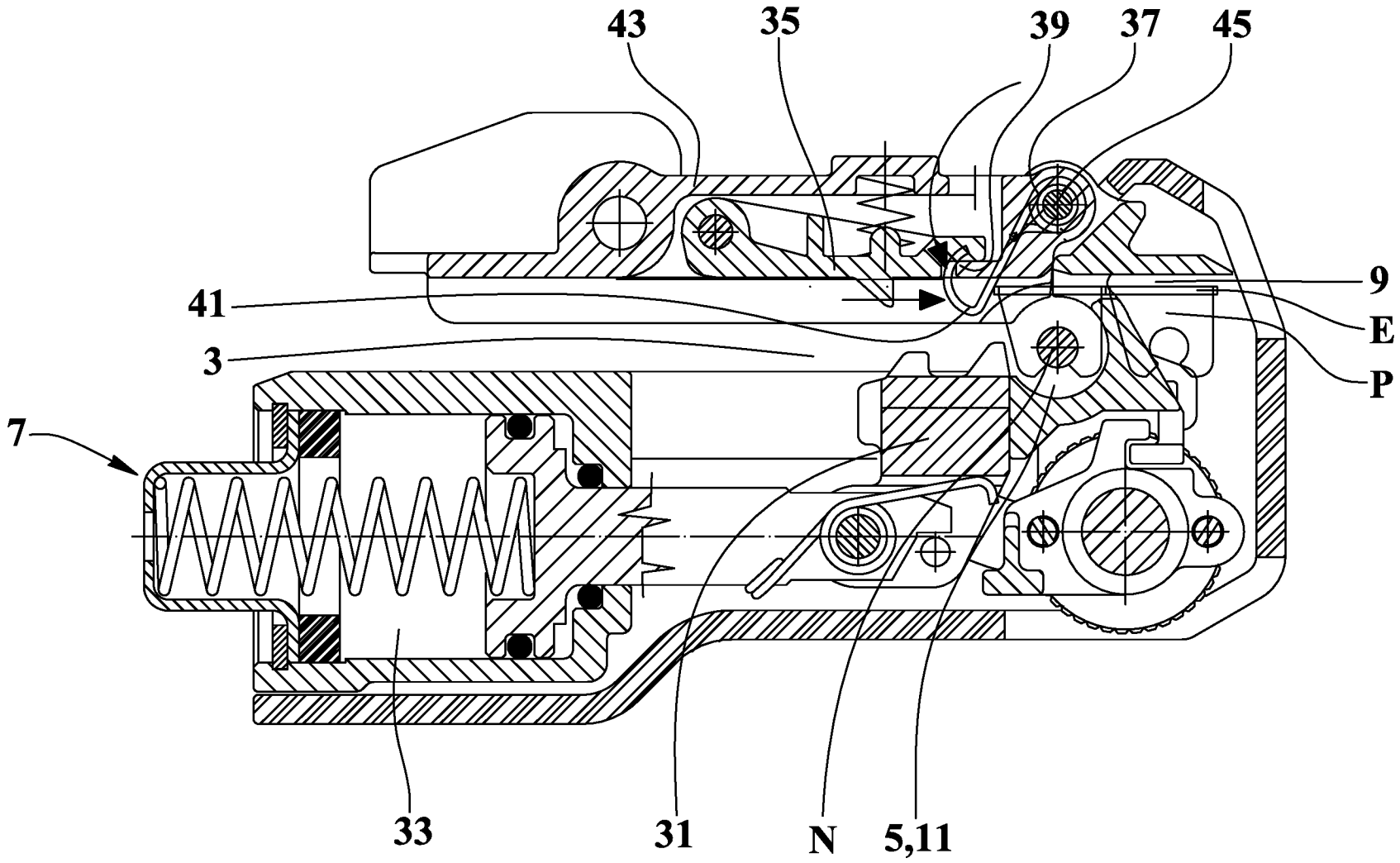

With reference from FIGS. 1-18, reference 1 indicates the nailer device for collated nails S, object of the present invention.

The collated nails S, also indicated as band or strip of nails, includes an elongated strip E with a nearly flat surface and equipped with at least a plurality of first connections P which stick out from it and each one is equipped with a fixing end F opposite to the end of the first connection and which is fixed to the remaining part of the elongated strip E and which is assigned to the removable fixing of a respective nail N.

Preferably the elongated strip E of the collated nails S is also equipped with a plurality of second connections D each one parallel, spaced and facing a corresponding first connection P with which it cooperates to the removable fixing of a same nail N. Each second connection D in equipped with a respective fixing end G, opposite to the remaining part of the elongated strip E and assigned to the removable fixing of the same nail N of the corresponding first connection P.

The first connections P are fixed to the longitudinal edge of the elongated strip E nearest to the thrusting means in the internal extreme condition and the second connections D are fixed to the opposite longitudinal edge of the elongated strip E that is the nearest edge to the exit end, or muzzle, of the nail outlet duct 11.

The fixing ends F, G of such connections P, D has respective circumferential arc recesses each one subtending to an angle exceeding 180° and which has radius equal or lightly lower to the radius of the stem of the nail which they have to block in a removable way.

Portions between two consecutive nails and one end of the elongated strip E could be equipped with respective windows or openings assigned to an arrest tooth which will be described below.

In FIGS. 1-6 the first connections P are placed above the second connections D.

The elongated strip E of the collated nails S is preferably made integral with the connection first connections P and second connections D and is preferably made of plastic material; such plastic material, generally has a certain degree of resilience which it keeps, at least partially, also after a plastic deformation.

Device 1 includes at least one magazine 3 for example consisting in one concave guide for example rectilinear, with an elongated C-shaped section, accessible and completed by a door 43 that is hinged to the device by means of a pivot pin 45. Such magazine 3 is assigned to receive, through the door 43, at least one collated nails, and it 3 flows into a shot chamber 5.

Said magazine 3 is equipped with a feeding mechanism 7 to feed the shot chamber 5 with a nail N, one at a time.

Device 1 also includes a sliding seat 9 aligned to the magazine 3 and communicating with the shot chamber 5 from which it receives, step by step as the nails are fired, the elongated strip E which brings the elongated strip to likewise exit the device step by step.

Device 1 also includes a nail outlet duct 11 aligned to the shot chamber 5 from which it receives a nail N pushed by an operative head of a thrusting means 13 aligned to the shot chamber and to the nail outlet duct 11. The thrusting means 13 is axially shifted, with a reciprocating motion, by a linear actuator, for example of pneumatic type. During the stroke of such thrusting means 13 between its internal extreme condition I and its external extreme condition B, through the shot chamber 5 and the outlet duct 11, the operative head of the thrusting means 13 expels and fixes the nail N, or rather it shoots it.

The thrusting means 13 is equipped with a matching means 15 assigned to match with the fixing end F of the first connection P which brings the fired nail in the stroke of the thrusting means 13 from its external extreme condition to its internal extreme condition to align such first connection P to the respective portion of the sliding seat. In the external extreme condition of the thrusting means 13, the matching means 15 is placed between the positions taken in such condition by the fixing ends F, G of the connection first P and second D connections of the fired nail. So the distance of the matching means 15 from the operative head of the thrusting means is determined according to the dimension of the element of the collated nails and the device so that when the operative head of the thrusting means 13 reaches its lower dead center, referring to the orientation of the device in FIG. 3, the matching means 15 goes over the fixing end F of the first connection P but does not reach the fixing end G of the second connection D, thereby placing itself between such fixing ends F, G.

The thrusting means 13 consists of a stem or a beam e.g. having a prismatic or preferably cylindrical shape, for example made of steel, and the matching means 15 may consist of a shoulder, for example ring-shaped, carried out in the material of the thrusting means 13, or rather inside the prismatic or cylindrical profile of the thrusting means, and oriented in a direction opposite to the exit for the nail N of the nail outlet duct 11.

A superficial segment of the thrusting means 13, starting from the matching means 15 and extending in a direction opposite to the exit for the nail N of the nail outlet duct 11 is tapered and/or bevelled. For example, the shoulder and the tapered segment of the matching means can be obtained by removal of material of the cylindrical or prismatic thrusting means 13 by means of turning or milling.

The portion of the sliding seat 9 which flows into the shot chamber 5 has a chamfered means 19 with inclined planes or curved surfaces to fillet the shot chamber 5 with the sliding seat 9, and said chamfered means 19 being assigned to guide the entrance of the first connections P in the sliding seat 9.

The feeding mechanism 7 includes a driving pawl means 31 activated by reciprocating motion by a linear actuator 33, for example of a pneumatic type, said driving pawl means 31 acting on at least one nail N of the collated nails S.

The feeding mechanism 7 includes a non-return pawl means 35 acting on the elongated strip E by means of its arrest tooth which can be engaged in respective windows of the elongated strip E.

Device 1 includes also an elastic pushing means 37 sticking out into the lumen of the magazine 3 and assigned to exert a force on the elongated strip E of the collated nails S at least partially oriented towards the shot chamber 5.

Such elastic pushing means 37 is assigned, on the one hand, to collaborate with the arrest tooth of the feeding mechanism 7, on the other hand to bring the last nail in the shot chamber and finally to stabilize the position of the collated nails and in particular of the nail in the shot chamber, contributing to the right bending and entering the first means of connection P by means of the matching means 15. It must be noted that the described feeding mechanism 7 is not sufficient to place correctly the last nail in the shot chamber.

The device includes also a locking means 39, for example consisting of fixed rise or beating match, assigned to stop the stroke of the elastic pushing means 37, stopping its thrust onto the elongated strip E when the last nail has been pushed and accurately placed by the elastic pushing means 37 itself in the shot chamber.

The elastic pushing means 37 includes a torsion helicoidal spring means which one operative end 41 acts on a longitudinal face of the elongated strip E and onto the rear end of the latter in correspondence with the last nail N.

The magazine 3 is equipped with a door 43 hinged around its own pivot pin 45 connected to the device, said 43 can be opened to insert in the magazine itself at least one collated nails S.

The lumen of the helicoid of the torsion helicoidal spring means is engaged by the pivot pin 45 around which the operative end 41 of the elastic pushing means 37 rotates.

The non-return pawl means 35 is housed in the door 43 and its sticking out arrest tooth is placed at a distance from the operative end 41 of the elastic pushing means 37 ranging from one third and five thirds of the distance between two nails N which are adjacent in the collated nails S.

The operation of the device provides that the thrusting means 13 in its nail shot stroke bends both of the first connection P and the second connection D towards the muzzle and that the matching means 15 during the return stroke of the thrusting means 13 hooks and bends the first connection P towards the direction opposite to the muzzle, allowing it to slide towards and along the sliding seat 9 without binds or blockages.

The elastic pushing means 37, as seen, contributes to avoid binds and allows to shoot also the last nail, which otherwise would be wasted.

The invention claimed is:

1. A nailer device for collated nails (S) comprising an elongated strip (E) almost flat shaped and provided with at least a plurality of first connections (P) projecting therefrom and each provided with a fixing end (F) opposite to the elongated strip (E) and assigned to the removable fixing of a respective nail (N); said device (1) comprises at least a magazine (3) for at least one collated nails, said magazine (3) leads into a shot chamber (5) and the magazine (3) is provided with a feeding mechanism (7) for feeding the shot chamber (5) with a nail (N) at a time; a sliding seat (9) aligned with the magazine (3) and in communication with the shot chamber (5) from which the sliding seat (9) receives the elongated strip (E) which the sliding seat (9) puts forward up to an outlet for the elongate strip; an outlet duct (11), for the nail, aligned to the shot chamber (5) from which the outlet duct (11) receives a nail (N) thrusted by a thrusting means (13), aligned with the outlet duct (11), during the stroke of such thrusting means (13) between an extreme internal condition (I) and an external extreme condition (B), through the shot chamber (5) and such outlet duct (11) to eject and fix the nail (N); wherein the thrusting means (13) is provided with a matching means (15) assigned to match with the fixing end (F) of the first connection (P) previously bearing the fired nail in the stroke of the thrusting means (13) from the external extreme condition of the thrusting means to the extreme internal condition of the thrusting means to align the first connection (P) of such fixing end (F) to a portion of the sliding seat.

2. The nailer device according to claim 1, wherein, in case of elongated strip (E) provided with a plurality of second connections (D) each facing to a corresponding first connection (P) with which said each second connection (D) cooperates to the removable fixing of a same nail (N), where each second connection is provided with a respective fixing end (G) for the nail (N), where the first connections (P) are fixed to a longitudinal edge of the elongated strip (E) closer to the thrusting means in the extreme internal condition and the second connections (D) are fixed to an opposite longitudinal edge of the elongated strip (E) closer to an outlet end of the outlet duct (11) for the nail (N), wherein when the thrusting means (13) is in the external extreme condition (B), the matching means (15) is placed between the positions assumed in this external extreme condition by the fixing end (F) of the first connection (P) and the fixing end (G) of the second connection (D) of the nail that has been fired.

3. The nailer device according to claim 2, wherein the fixing end (F) of each first connection is fixed to a stem of a respective nail closer to the thrusting means in the extreme internal condition and the fixing end (G) of each second connection is fixed to the stem of the respective nail closer to the outlet end of the outlet duct (11).

4. The nailer device according to claim 1, wherein the thrusting means (13) consists of a prismatic or cylindrical stem or rod and that the matching means (15) consists of a shoulder made in the material of the thrusting means (13) and facing in the opposite direction in respect to the outlet end of the outlet duct (11).

5. The nailer device according to claim 4, wherein a surface portion of the thrusting means (13) starting from the matching means (15) and in the opposite direction in respect to the outlet end of the outlet duct (11) is tapered, smoothed, or tapered and smoothed.

6. The nailer device according to claim 4, wherein in a return stroke of the thrusting means after firing a nail, the matching means matches with a free end of the first connection, opposite to an exit of the fired nail via the outlet duct.

7. The nailer device according to claim 1, wherein the portion of the sliding seat (9) leading into the shot chamber (5) has chamfered means (19) connecting the shot chamber (5) to the sliding seat (9) and assigned to drive the entrance of at least the first connections (P) into the sliding seat (9).

8. The nailer device according to claim 1, wherein the feeding mechanism (7) comprises a driving pawl (31) operated in reciprocating motion by an actuator (33) and acting on a nail (N) of the collated nails (S) and the feeding mechanism (7) comprises a non-return pawl (35) acting on the elongated strip (E).

9. The nailer device according to claim 8, further comprising an elastic pushing means (37) projecting into the cavity of the magazine (3) and assigned to exert a force on the elongated strip (E) of the collated nails (S) at least partially directed towards the shot chamber (5), and the nailer device further comprises a locking mechanism (39) assigned to lock a thrust of the elastic pushing means (37) on the elongated strip (E) when a last nail has been thrusted by the elastic pushing means (37) into the shot chamber.

10. The nailer device according to claim 9, wherein the elastic pushing means (37) comprises a helicoidal torsion spring having an operative end (41) that acts on a longitudinal face of the elongated strip (E) and on a rear end of the elongated strip (E) in correspondence with the last nail.

11. The nailer device according to claim 10, wherein the magazine (3) is provided with a door (43) hinged about a pivot pin (45) and openable for the insertion into the magazine of the at least one collated nails, wherein a cavity of a helix of the helical torsion spring means is engaged by the pivot pin (45).

12. The nailer device according to claim 11, wherein the non-return pawl means (35) is housed in the door (43) and a projecting tooth of the non-return pawl is placed at a distance from the operative end (41) of the elastic pushing means (37) ranging from one third to five thirds of a distance between two adjacent nails of the collated nails (S).

13. The nailer device according to claim 1, wherein the fixing end (F) of each first connection is fixed to a stem of a respective nail of the collated nails (S).

14. The nailer device according to claim 1, wherein in a return stroke of the thrusting means after firing a nail, the matching means matches with a free end of the first connection, opposite to an exit of the fired nail via the outlet duct.

15. The nailer device according to claim 14, wherein the first connection is in a bended position after the exit of the fired nail and in a return stroke of the thrusting means after firing the fired nail the matching means substantially aligns the first connection to a geometric plane of the elongated strip followed by a return of the first connection to an orientation again opposite to the elongated strip for free sliding of the elongated strip into the sliding seat.

* * * * *